US011428150B2

(12) United States Patent
Jackson et al.

(10) Patent No.: US 11,428,150 B2
(45) Date of Patent: Aug. 30, 2022

(54) SYSTEM AND METHOD FOR ROTATIONAL COMBUSTION ENGINE

(71) Applicant: Matthew Jackson, Graham, WA (US)

(72) Inventors: Matthew Jackson, Graham, WA (US); Glen Jackson, Issaquah, WA (US)

( * ) Notice: Subject to any disclaimer, the term of this patent is extended or adjusted under 35 U.S.C. 154(b) by 346 days.

(21) Appl. No.: 16/807,047

(22) Filed: Mar. 2, 2020

(65) Prior Publication Data

US 2020/0277890 A1 Sep. 3, 2020

Related U.S. Application Data

(60) Provisional application No. 62/812,827, filed on Mar. 1, 2019.

(51) Int. Cl.

| | |
|---|---|
| ***F02B 1/04*** | (2006.01) |
| ***F01L 1/26*** | (2006.01) |
| ***F01B 9/02*** | (2006.01) |
| ***F01B 3/00*** | (2006.01) |
| ***F02B 57/00*** | (2006.01) |
| ***F02B 75/26*** | (2006.01) |
| ***F02B 75/04*** | (2006.01) |
| ***F02F 1/42*** | (2006.01) |
| ***F01L 1/053*** | (2006.01) |
| ***F02F 1/24*** | (2006.01) |
| ***F02B 75/18*** | (2006.01) |
| ***F01L 1/047*** | (2006.01) |

(Continued)

(52) U.S. Cl.

CPC ..... *F02B 1/04* (2013.01); *F01B 3/007* (2013.01); *F01B 3/0032* (2013.01); *F01B 9/026* (2013.01); *F01L 1/265* (2013.01); *F02B 57/00* (2013.01); *F02B 75/04* (2013.01); *F02B 75/26* (2013.01); *F01B 2009/061* (2013.01); *F01L 1/0532* (2013.01); *F01L 1/08* (2013.01); *F01L 2001/0473* (2013.01); *F02B 2075/1816* (2013.01); *F02B 2275/18* (2013.01); *F02F 1/4214* (2013.01); *F02F 2001/245* (2013.01)

(58) Field of Classification Search

CPC .. F02B 1/04; F02B 57/00; F02B 75/04; F02B 75/26; F02B 2075/1816; F02B 2275/18; F01B 3/0032; F01B 3/007; F01B 9/026; F01B 2009/061; F01L 1/265; F01L 1/0532; F01L 1/08; F01L 2001/0473; F01L 1/13; F01L 1/053; F01L 2305/00; F01L 1/182; F01L 1/026; F02F 1/4214; F02F 2001/245

See application file for complete search history.

(56) References Cited

U.S. PATENT DOCUMENTS 4,767,939 A * 8/1988 Calley ..... F03D 7/0216 416/41

FOREIGN PATENT DOCUMENTS

CN 202065379 U * 12/2011
WO WO-2007070651 A1 * 6/2007 ..... F01B 3/0032
WO WO-2017120141 A1 * 7/2017

* cited by examiner

*Primary Examiner* — Jacob M Amick
*Assistant Examiner* — Charles J Brauch
(74) *Attorney, Agent, or Firm* — Christopher Mayle; Bold IP, PLLC

(57) ABSTRACT

A rotational combustion engine that generates force from the reciprocal motion and centripetal motion of one or more pistons that is then converted into rotational motion of a first cam and second cam wherein the cams are separated by a 2-3 degree horizontal offset and an angle of 60 degrees as well as camshaft assembly and driving shaft to provide power to an entity such as an automobile.

18 Claims, 12 Drawing Sheets

(51) Int. Cl.
*F01B 9/06* (2006.01)
*F01L 1/08* (2006.01)

SYSTEM AND METHOD FOR ROTATIONAL COMBUSTION ENGINE

CROSS REFERENCE TO RELATED APPLICATIONS

This application is a Non-Provisional application which claims priority to U.S. Provisional Application No. 62/812,827 filed on Mar. 1, 2019, which is incorporated by reference in its entirety.

FIELD OF DISCLOSURE

The overall field of this invention is a system and method for a rotational combustion engine and more particularly concerns an improved internal combustion engine having pistons reciprocating between a pair of rotatable cams whereby the engine converts reciprocal motion into rotational motion, producing more horsepower with less energy.

BACKGROUND

The internal combustion engine is a type of engine that generates motive power by the burning of gasoline, oil, or other fuel, in a confined space called a combustion chamber. This reaction of a fuel with an oxidizer creates gases of high temperature and pressure, which are permitted to expand, directly causing movement by acting to drive a series of pistons to transfer force to the motor. The internal combustion engine has been used for over a century, and though there have been many advances and variations, there has always been a need for improvement in horsepower, torque, efficiency, cost, reliability, size, and, more recently, emissions. There have been multiple types of internal combustion engine, the most popular being the reciprocating engine.

Reciprocating engines, whether they are configured in-line or in a V configuration, require a large and heavy engine block to house the cylinders and pistons. They also require a driving shaft to transfer the linear motion of the pistons to rotational motion. In addition, camshafts and timing belts ensure the proper timing of the engine. All of these components increase the cost to build and maintain the engine. These components increase the size of the engine, which means you need more space to produce power. In addition, these parts and the engine block make the engine heavy, which reduces efficiency and requires a substantial housing to mount the engine. These engines also produce very low torque at low revolutions per minute or RPM, meaning the engine has to work harder, and in a less efficient manner. They are further limited in the maximum RPM allowable.

Piston-less rotary engines, particularly the Wankel engine, were designed to increase the horsepower by volume and by weight and reduce the amount of moving parts needed. However, Wankel engines have very poor fuel economy, as there is an incomplete combustion of the fuel air mixture. Emissions are poor because the incomplete combustion leads to unburned hydrocarbons entering the environment through the exhaust. Emissions are also problematic because of the need for the engine to burn oil to keep the engine lubricated. Wankel engines also have sealing issues, especially with the hot and cold cycles of normal use, which require the engine to be taken apart to fix.

Other less popular engine designs attempt to solve these various problems, but they all fail in some sort of factor that prevents them from more widespread adoption. Thus, exists a need for a secure and reliable engine that reduces the energy needed to provide torque to an engine.

SUMMARY

The preceding and following embodiments and descriptions are for illustrative purposes only and are not intended to limit the scope of this disclosure. Other aspects and advantages of this disclosure will become apparent from the following detailed description.

The present invention is directed to a machine comprising a first cam arranged at an angle on the vertical plane, a connector attached to the first cam, a second cam attached to the connector arranged at an angle on the vertical plane at a horizontal offset compared to the first cam, the first cam and the second cam configured to rotate in unison, one or more cylinders with an intake valve and an exhaust valve, the one or more cylinders attached to the first cam, a piston attached to and movable within each cylinder of the one or more cylinders, the pistons configured to move as the first and the second cam rotate, wherein the horizontal offset is a 2 to 3-degree horizontal offset, wherein there is an acute angle between the first cam and the second cam, further comprising a driving shaft mounted for rotation about an axis connected to the second cam wherein the driving shaft and the second cam are configured to rotate in unison, wherein the connector is a ball and socket fastener, wherein the pistons each have a connecting rod, the connecting rods having one or more rod connectors connected to the second cam, wherein the first cam has a plurality of apertures wherein the one or more cylinders are positioned within the plurality of apertures, wherein the first cam is connected to a first gear mounted to the center of first cam, the first gear configured to move in unison with the first cam, the first gear connected to a plurality of second gears, the second gears connected to a plurality of inlet camshafts and outlet camshafts configured to control the opening and closing of inlet valves and exhaust valves, the inlet valves and the exhaust valves connected to each of the cylinders of the one or more cylinders, the plurality of inlet camshafts and outlet camshafts having one or more lobes wherein when the plurality of inlet camshafts and outlet camshafts spin, the lobes are configured to open and close the plurality of intake valves and exhaust valves in time with the motion of the pistons.

The present invention further directed to a machine comprising, a first cam arranged at an angle on the vertical plane, a second cam arranged at an angle on the vertical plane at a horizontal offset compared to the first cam, the first cam and the second cam configured to rotate in unison, a middle component with a first and second intermediate cams and one or more combustion chambers, a first set of cylinders, the first set of cylinders connected to a first intermediate cam, a second set of cylinders, the second set of cylinders connected to a second intermediate cam, the first set of cylinders and the second set of cylinders coaxial to each other, a first set of pistons movable within the first set of cylinders, a second set of pistons movable within the second set of cylinders; the second set of pistons in opposing direction to the first set of pistons, the first set of pistons and the second set of pistons configured to move as the first cam and the second cam rotate, wherein a volume enclosed within one of the combustion chambers is between one of the pistons in the first set of pistons and one of the pistons in the second set of pistons, the one or more combustion chambers each connected to an intake port and an exhaust port, wherein the horizontal offset is a 2 to 3-degree horizontal offset, wherein there is an acute angle between the first cam and the second cam, further comprising a first and second driving shaft mounted for rotation about an axis extending connected to the first cam and the second cam wherein the driving shafts, the first cam, and the second cam are configured to rotate in unison, wherein the first set of pistons and the second set of pistons each have a connecting rod, the connecting rods having one or more rod connectors connected to the first cam and the second cam, respectively, wherein the first and the second intermediate cams have a plurality of apertures wherein the cylinders are positioned within the plurality of apertures.

The present invention further directed to a machine comprising a first cam arranged at an angle on the vertical plane, a connector attached to the first cam, a second cam attached to the connector arranged at an angle on the vertical plane at a horizontal offset compared to the first cam, the first cam and the second cam configured to rotate in unison, one or more cylinders with an intake valve and an exhaust valve, the one or more cylinders attached to the first cam or the second cam, a piston attached to and movable within each cylinder, the pistons configured to move as the first and the second cam rotate, wherein the pistons each have a connecting rod, the connecting rods having one or more rod connectors connected to the first or the second cam, further comprising a driving shaft, the driving shaft mounted for rotation about an axis connected to the second cam wherein the driving shaft and the second cam are configured to rotate in unison, the driving shaft configured to develop a rotating magnetic field that generates current in armature winding located in a stator.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
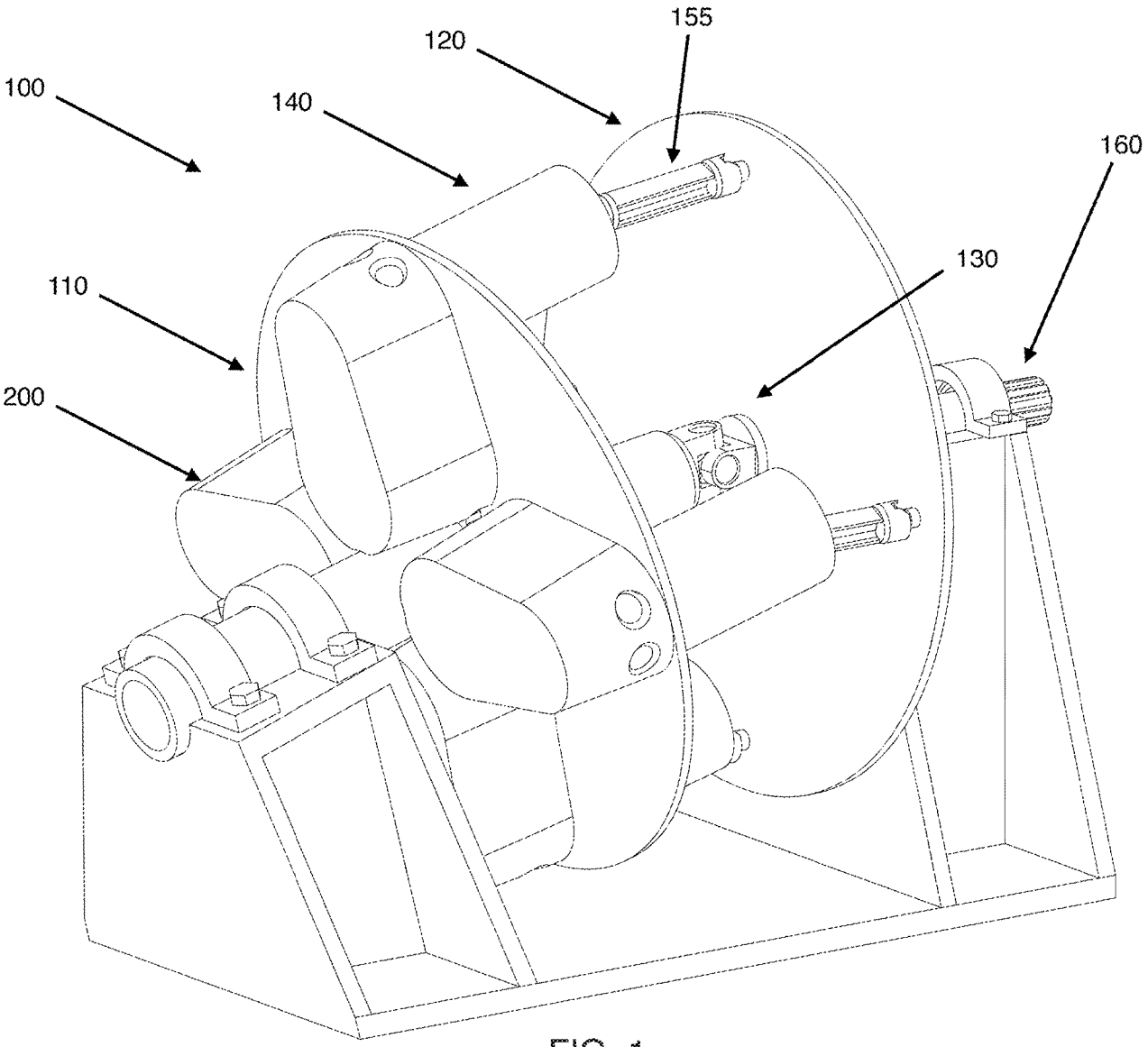
FIG. 1 depicts a perspective view of the rotational combustion engine.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

The present disclosure recognizes the unsolved need for a rotational combustion engine that offers an efficient way for utilizing centripetal forces and reciprocal forces for producing horsepower from an increased amount of torque, thus lowering the amount of revolutions per minute, engine size, and energy needed for the engine to operate. The rotational combustion engine generates force from the reciprocal motion and centripetal motion of the pistons being converted into rotational motion of the second cam with respect to the first cam causing second cam rotation. This provides rotational motion in the first cam and camshaft assembly as well as the driving shaft to provide power to an entity.

FIG. 1 is an illustration of rotational combustion engine 100 constructed in accordance with the principals of the current invention. Rotational combustion engine 100 is positioned on a stand but it should be appreciated that it may be incorporated into various structures or systems. Rotational combustion engine 100 may include a first cam and second cam, such as first cam 110 and second cam 120 of the same plate or disc shape which may rotate within a housing of any number of land or water vehicles, including but not limited to: automobiles, motorcycles, ships, or locomotives. In one or more non-limiting embodiments, the housing may be excluded and rotational combustion engine 100 may be enclosed directly in an entity or completely exposed as a standalone energy generating source.

First cam 110 and second cam 120 may be separated by a distance with an angle of 60 degrees between the first cam 110 and second cam 120. In some embodiments, first cam 110 and second cam 120 may be on a level plane, first cam 110 and second cam 120 each having a 60-degree angle with the level plane. First cam 110 and second cam 120 may be circular or substantially circular in shape. However, this is non-limiting and first cam 110 and second cam 120 may be any or any combination of the same or different shapes. First cam 110 and second cam 120 have difference in angle of 2-3 degrees to the plane of rotation around the first cam 110 and second cam 120. First cam 110 and second cam 120 may be connected by a connector such as a ball and socket fastener, such as ball and socket 130 with a bearing member shaped like ball or ball-like component configured to be introduced radially in a spherical, cup-shaped cavity from the outside of the spherical, cup-shaped cavity through a spherical, cup-shaped opening. The spherical, cup-shaped cavity extends toward the spherical, cup-shaped opening beyond the centerline, forming a shoulder, which grips the bearing member from behind so that the bearing member is retained within the spherical cup shaped cavity. This provides a plurality of possible orientations for the axis of rotation of the bearing member within the spherical, cup-shaped recess and permits three-dimension pivot movement between first cam 110 and second cam 120.

The bearing member may be connected, fastened, or integral to a rod or other structure fastened to first cam 110 or second cam 120 while the spherical, cup-shaped cavity may be connected, fastened, or integral to a second rod or other structure fastened to first cam 110 or second cam 120 whereby when first cam 110 or second cam 120 moves, the other cam moves in unison. Though a ball and socket joint is described, other types of joints may be used to connect first cam 110 and second cam 120 together, such as a knuckle joint, turnbuckle, pin joint, cotter joint, bolted joint, screw joint, prismatic joint, a rod directly connected to first cam 110 and second cam 120, or any type of joint or fastener that allows first cam 110 and second cam 120 to rotate and does not stray from the purpose and spirit of the present invention.

First cam 110 or second cam 120 may have a plurality of apertures whereby a plurality of cylinders such as cylinders 140 are mounted on and connected to first cam 110 and second cam 120 and positioned within the plurality of apertures. Cylinders 140 may be in axial alignment with each other on one plane while in other non-limiting embodiments may be at different angles. Any number of apertures and corresponding cylinders 140 may be provided, however, this description will proceed with the example of four apertures which are distributed uniformly over its circumference on first cam 110 and four apertures which are distributed uniformly over its circumference on second cam 120 and four corresponding cylinders 140 positioned between first cam 110 and second cam 120 along with any associated components with the apertures and cylinders 140. Cylinders 140 have a first end and a second end, the second end having a cylindrical opening in contact with second cam 120 or an adapter gear, the first end utilized as part of a combustion chamber.

Figure 2:
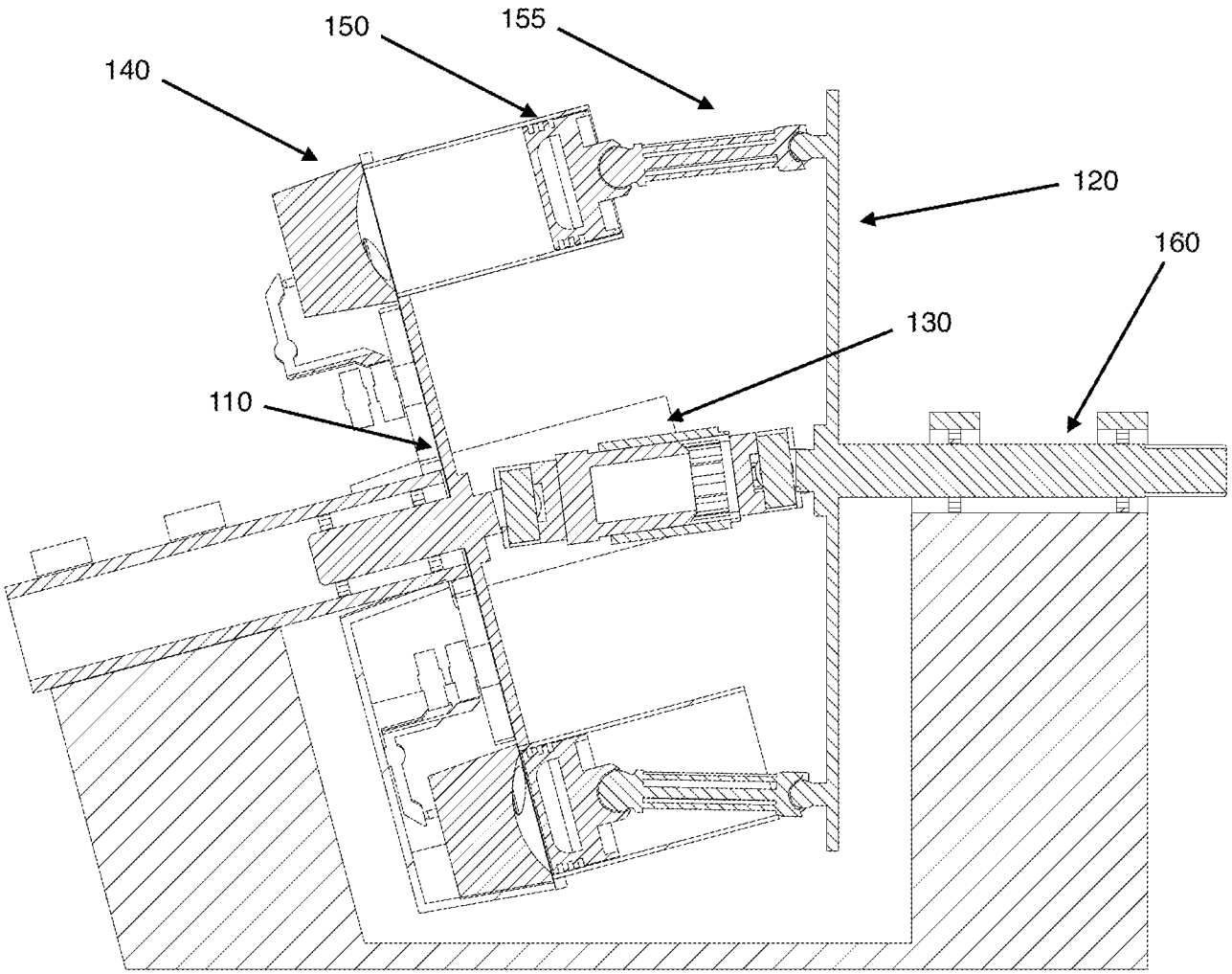
FIG. 2 depicts a cross sectional view of the line indicated in FIG. 5
Figure 3:
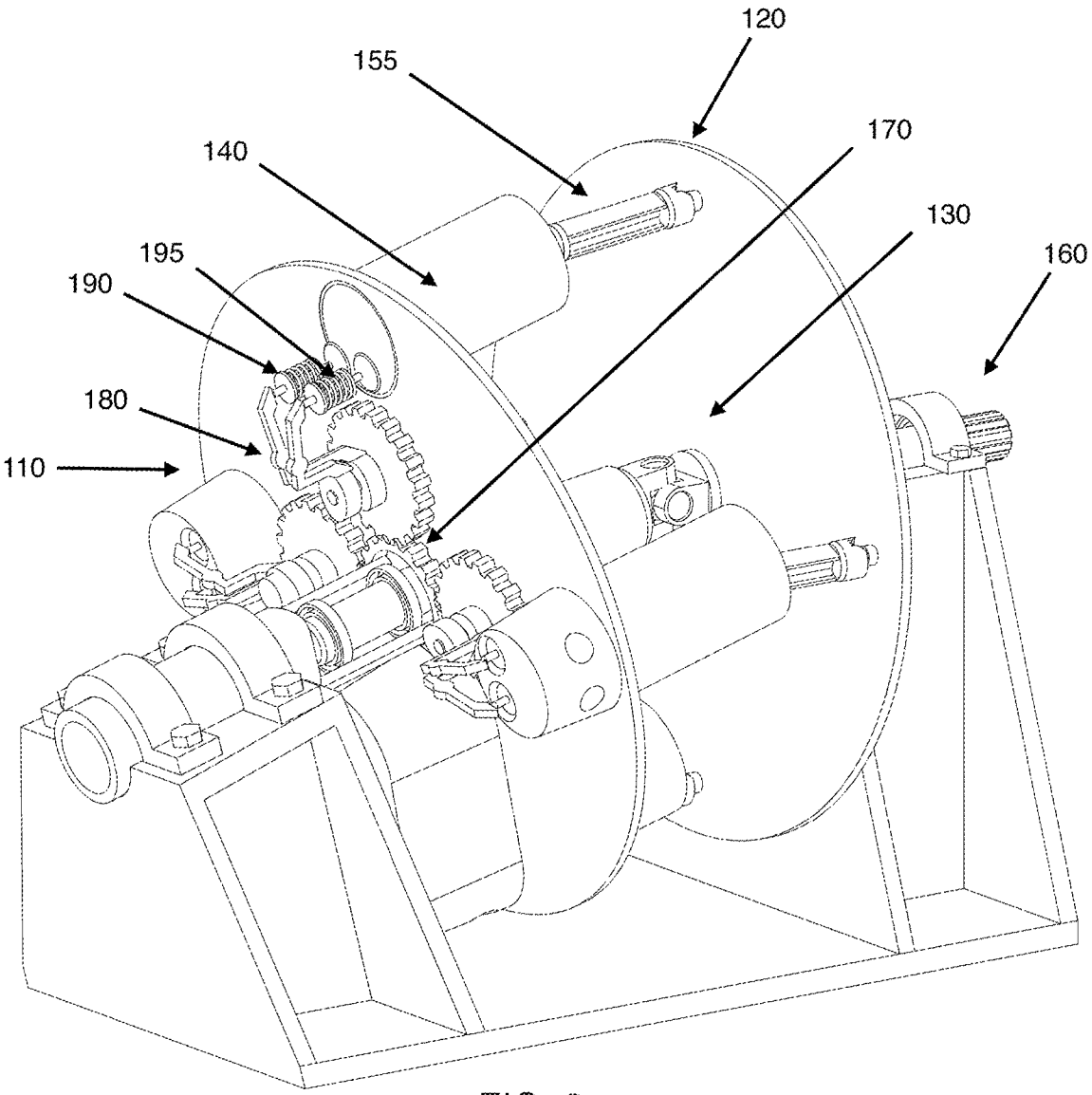
FIG. 3 depicts a front perspective view of the rotational combustion engine.
Figure 4:
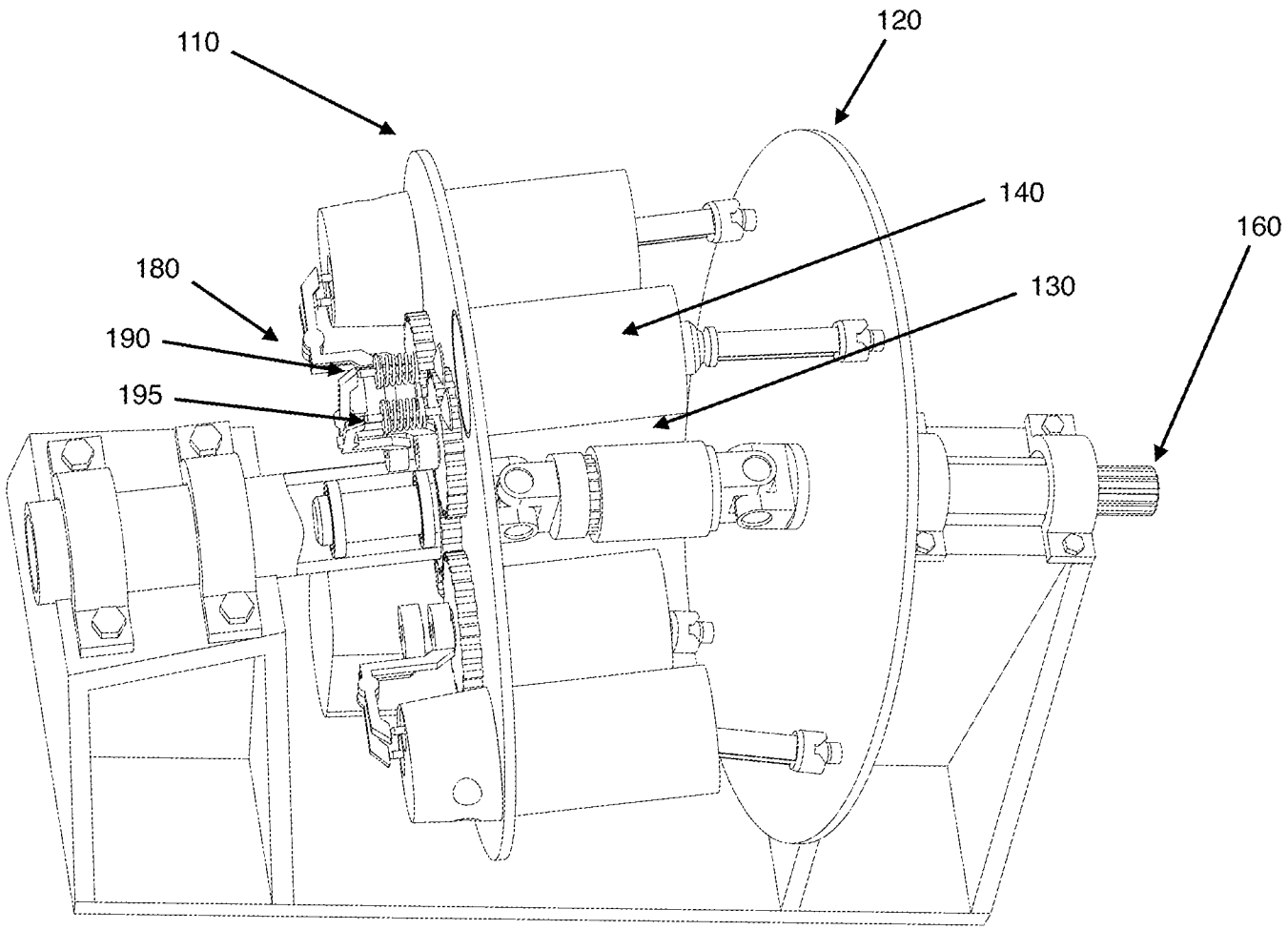
FIG. 4 depicts a top perspective view of the rotational combustion engine.
Figure 5:
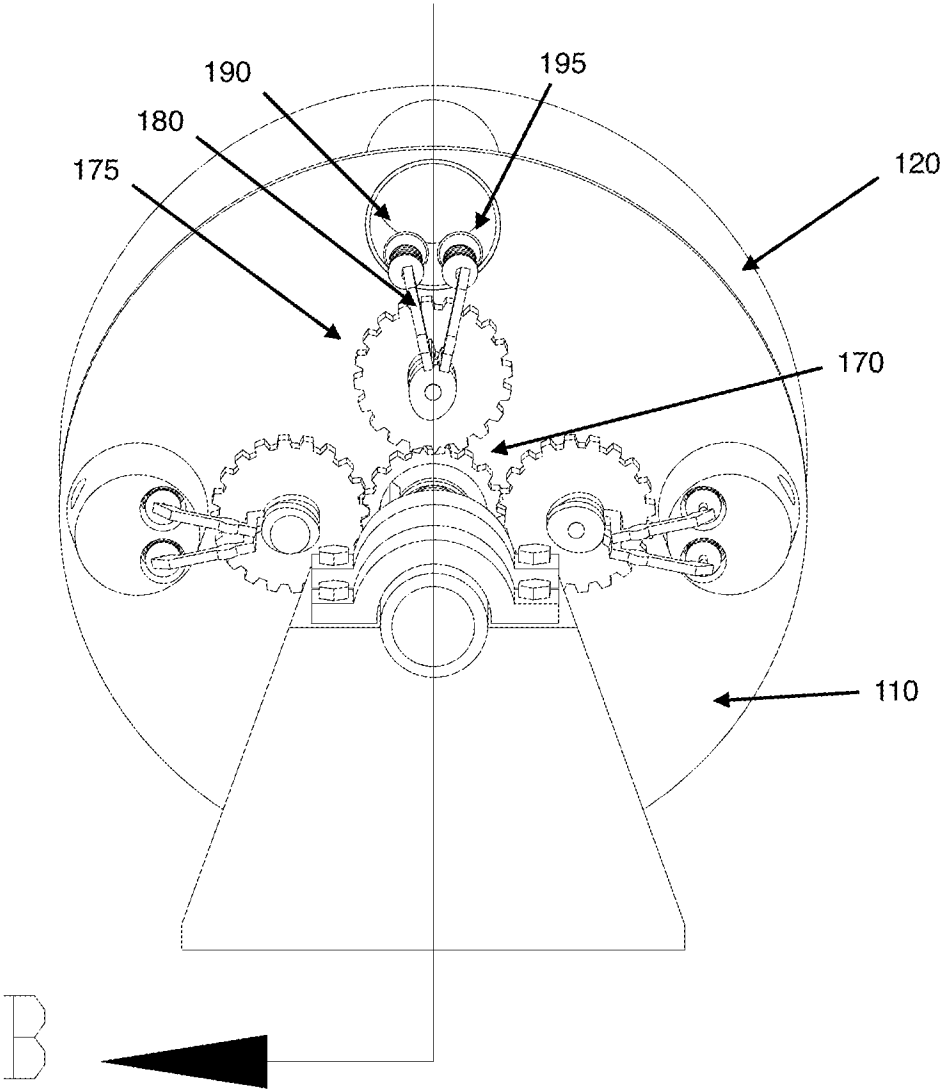
FIG. 5 depicts a side view of the rotational combustion engine.
Figure 6:
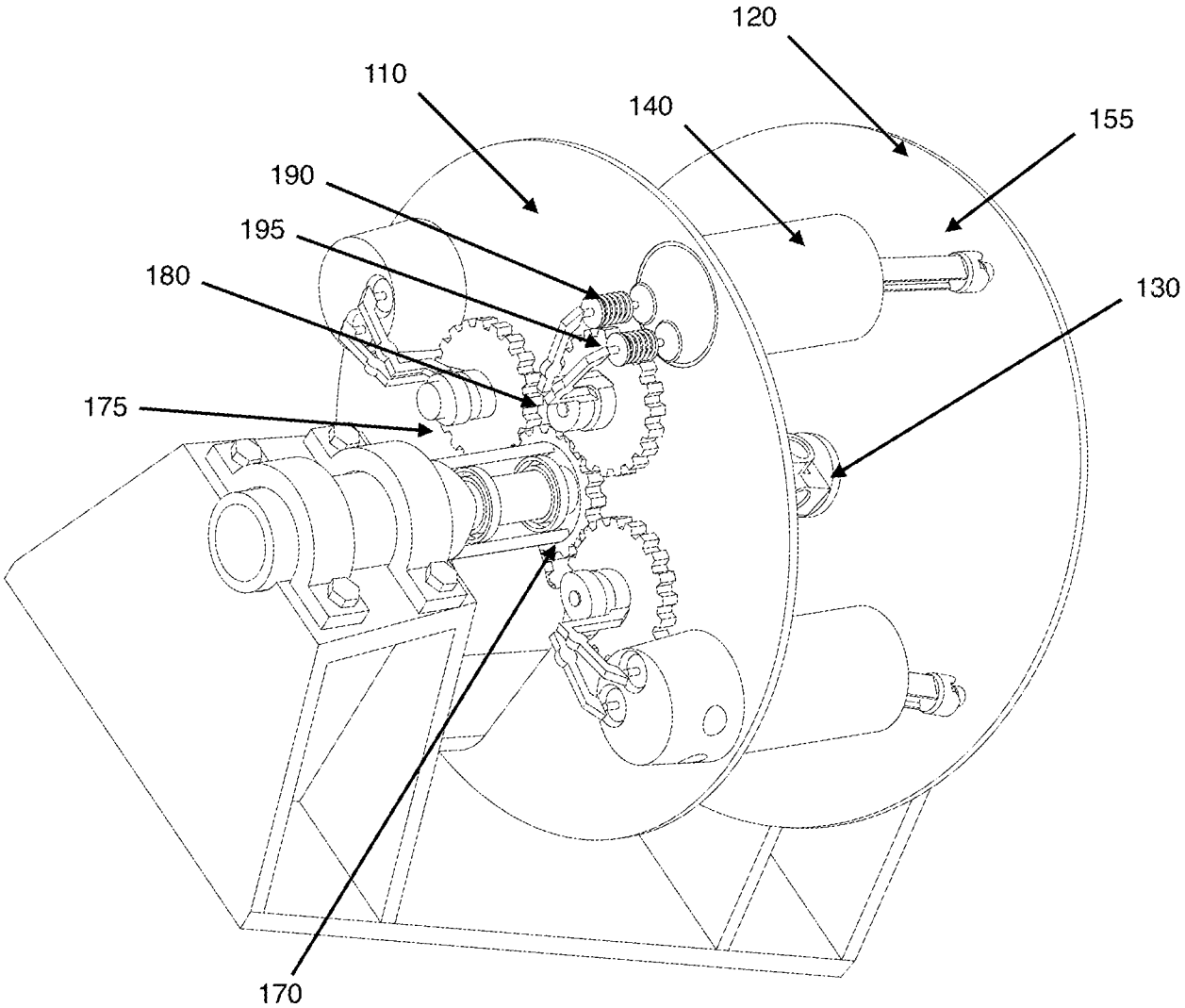
FIG. 6 depicts another top perspective view of the rotational combustion engine.

Pistons 150 may fit slidably and displaceably within each of cylinders 140, as illustrated in FIG. 2, whereby pistons 150 may be coaxial with cylinders 140 and have relative motion within cylinders 140. Pistons 150 may have one or more piston rings configured to create a seal between the outer circumference of pistons 150 and the inner circumference of cylinders 140 to ensure that forces are prevented from escaping around pistons 150. Pistons 150 may be made of a cast aluminum alloy or other material exhibiting well-produced lightweight thermal conductivity; however, this is non-limiting and pistons 150 may be made of any suitable metal or composite. In some embodiments cams 110 and 120 or cylinders 140 may have one or more rollers that restrain the movement of the pistons such as when the pistons 150 deviate upwards from the prescribed path from cams 110 and 120. Cams 110 and 120 or cylinders 140 may have one or more piston-anti rotation rails comprised of roller bearings and a track that may be connected.

Pistons 150 may each have a connecting rod such as connecting rods 155 whereby connecting rods 155 have one or more rod connectors linked to second cam 120 or an adapter gear mounted to second cam 120 that moves in unison with second cam 120. Adapter gear may be in the form of a spoke wheel. First cam 110 and second cam 120 rotate around a 2-3 degree angle causing pistons 150 and connecting rods to travel at different angles as a function of the angular position of the first cam 110 and second cam 120. Adapter gear may have a similar inclination in relation to the centerline of pistons 150. Second cam 120 or adapter gear may have one or more receiving elements for the piston rod connectors. A driving shaft 160 may be mounted for rotation about an axis extending perpendicular to and preferably intersecting a receiving element in the center of second cam 120 or adapter gear whereby driving shaft 160 is mounted to second cam 120 or adapter gear whereby driving shaft 160 and second cam 120 may rotate in unison.

Pistons 150 may be coupled to driving shaft 160 by way of second cam 120 or adapter gear, connecting rod 155, and rod connectors, whereby when second cam 120 is rotated from the reciprocal motion of pistons 150, driving shaft 160 as well as first cam 110 rotate. For purposes of this specification, the direction of rotation of driving shaft 160 may be described as in the counterclockwise direction, however, it obvious to one of ordinary skill in the art that driving shaft 160 may rotate in the opposite direction or clockwise direction.

This configuration is designed so that when a first piston 150 is pushed out, driving shaft 160 rotates in one direction and the energy from the other three pistons 150 keeps driving shaft 160 rotating in the same direction when the energy from first piston 150 is spent. In one or more non-limiting embodiments, other types of configurations or gearing may be used to transmit the reciprocating motion of pistons 150 into rotary motion causing secondary cam rotation by the change in direction of pistons 150 and connecting rods with respect to second cam 120 from first cam 110 as well to drive driving shaft 160.

A flywheel (not shown) for smoothing rotation, storing rotational energy, and dampening engine vibrations caused by the firing of each piston 150 may be attached to the second end of driving shaft 160 in the axial direction. The flywheel may be rotatable with driving shaft 160 such that outward reciprocal motion of pistons 150 also restores rotational energy to the flywheel for the next cycle. In one or more non-limiting embodiments, oil may be used to assist in the lubrication of pistons 150, connecting rods 155, and driving shaft 160 as well as any other components in rotational combustion engine 100. The flywheel may also be coupled with a clutch disk, a pressure plate, a throw-out bearing, and a linkage whereby the flywheel provides a smooth-machined friction surface that the clutch can contact.

In some embodiments rotational combustion engine 100 may use alternating current electrical energy to produce mechanical energy in the form of rotation. A connected stator may receive three-phase alternating current creating a rotating magnetic field whereby an armature winding on the driving shaft receives a magnetic field from the stator, which generates electricity in the armature winding that turns the driving shaft.

Cylinders 140 may have a combustion chamber as a section or region of each cylinder 140 whereby the volume enclosed within the combustion chamber is between the first end of each cylinder 140, the walls of each cylinder 140, and each piston 150. Spark plugs may be mounted centrally in the combustion chamber in cylinders 140, the spark plugs connected to an ignition system capable of delivering electric current to the spark plug to generate at least 20,000 volts for combustion. Spark plus may also be energized through a high-tension lead, such as by one or more magnetos driven by the driving shaft. Spark plugs may be threaded into the interior of cylinders 140 to ignite the compressed fuel air mixture.

First cam 110 may be mechanically coupled to a gear such as gear 170, as illustrated in FIG. 3 through 6, whereby gear 170 is stationary and mounted to the center of first cam 110. There is no relative movement compared to that of first cam 110, so gear 170 and first cam 110 move in unison. Gear 170 may be attached to a plurality of secondary gears, such as secondary gears 175. Secondary gears 175 may be mechanically coupled to a plurality of inlet camshafts and outlet camshafts, such as camshafts 180, which control the opening and closing of inlet valves, such as inlet valves 190, and exhaust valves, such as exhaust valves 195, connected to each of cylinders 140. Camshafts 180 may have one or more lobes whereby as camshafts 180 spin, the lobes open and close intake valves 190 and exhaust valves 195 in time with the motion of pistons 150.

The lobes may be any type of lobe, such as but not limited to a flat tappet or roller cam. The lobes may have any number of profiles with different specifications for its nose, flank, heel, base circle, opening and closing ramp, and lobe lift. The lobes may have a symmetrical profile where the opening and closing ramps are the same, causing valves 190 and 195 to open and close at the same rate. The lobes may have an unsymmetrical profile where the opening and closing ramps are different, causing valves 190 and 195 to open more quickly and close more slowly. Camshafts 180 may be a dual pattern camshaft having intake lobes with a different profile than the exhaust lobes or a single pattern where the intake and exhaust lobes have the same profile.

Inlet valves 190 may be comprised of an inlet valve inlet or nozzle mounted on the combustion chamber or a passageway leading to the combustion chamber, a disc held against the inlet valve inlet to prevent flow under normal conditions, and a spring to press against and hold the disc closed. When the lobe is rotated by the rotation of camshaft 180 and the lobe is pressing against inlet valve 190, the spring becomes compressed and inlet valve 190 becomes displaced, allowing a fuel air mixture to enter from the inlet passageway into the combustion chamber of cylinders 140. As camshaft 180 is further rotated, the lobe no longer presses against inlet valve 190, allowing the spring to become decompressed, returning inlet valve 190 to its original closed position.

A carburetor (not shown) may be used to supply the fuel air mixture through the intake passage, to intake valve 190. The carburetor may be an all-position type, such as a diaphragm carburetor, however, this is non-limiting and any carburetor known by those of ordinary skill in the art may be used. The carburetor may have one or more valves connected across a fuel inlet and air inlet to the carburetor allowing the fuel air mixture to flow only in the direction from the carburetor to the intake passage as well as regulating the amount of air and fuel that passes through. The air inlet of the carburetor may be connected to an air filter or the open outside environment. The fuel inlet of the carburetor may be connected by a fuel tube or pipe to a supply tank or reservoir configured to hold and contain fuel, oil, or fuel oil mixture such as a combination of gasoline and oil. The oil may be the type commonly used with small four-stroke engines. As air flows into the carburetor, the air passes through a venturi causing the pressure to fall, drawing air through the fuel pipe, pulling the fuel in from the fuel pipe into the carburetor, and creating a fuel air mixture that may flow out through the intake passage.

Exhaust valves 195 may be comprised of an exhaust valve inlet or nozzle mounted on the combustion chamber or a passageway leading to the combustion chamber, a disc held against the exhaust valve inlet to prevent flow under normal conditions, and a spring to press against and hold the disc closed. When the lobe is rotated by the rotation of camshaft 180 and the lobe is pressing against exhaust valve 195, the spring becomes compressed and exhaust valve 195 becomes displaced, allowing exhaust flow from the products of combustion, including carbon dioxide, water vapor, and other hydrocarbons to move out past exhaust valve 195 and into the exhaust passageway. As outlet camshaft is further rotated, the lobe no longer presses against the exhaust valve allowing the spring to become decompressed, returning the exhaust valve to its original closed position.

The exhaust passageway may be connected to an exhaust duct that conveys the exhaust from cylinders 140 to a muffler, exit port, catalytic converter, or outside environment. The exhaust duct may have a one-way or check valve to prevent the flow of the exhaust in the opposite direction away from the exhaust duct.

Figure 7:
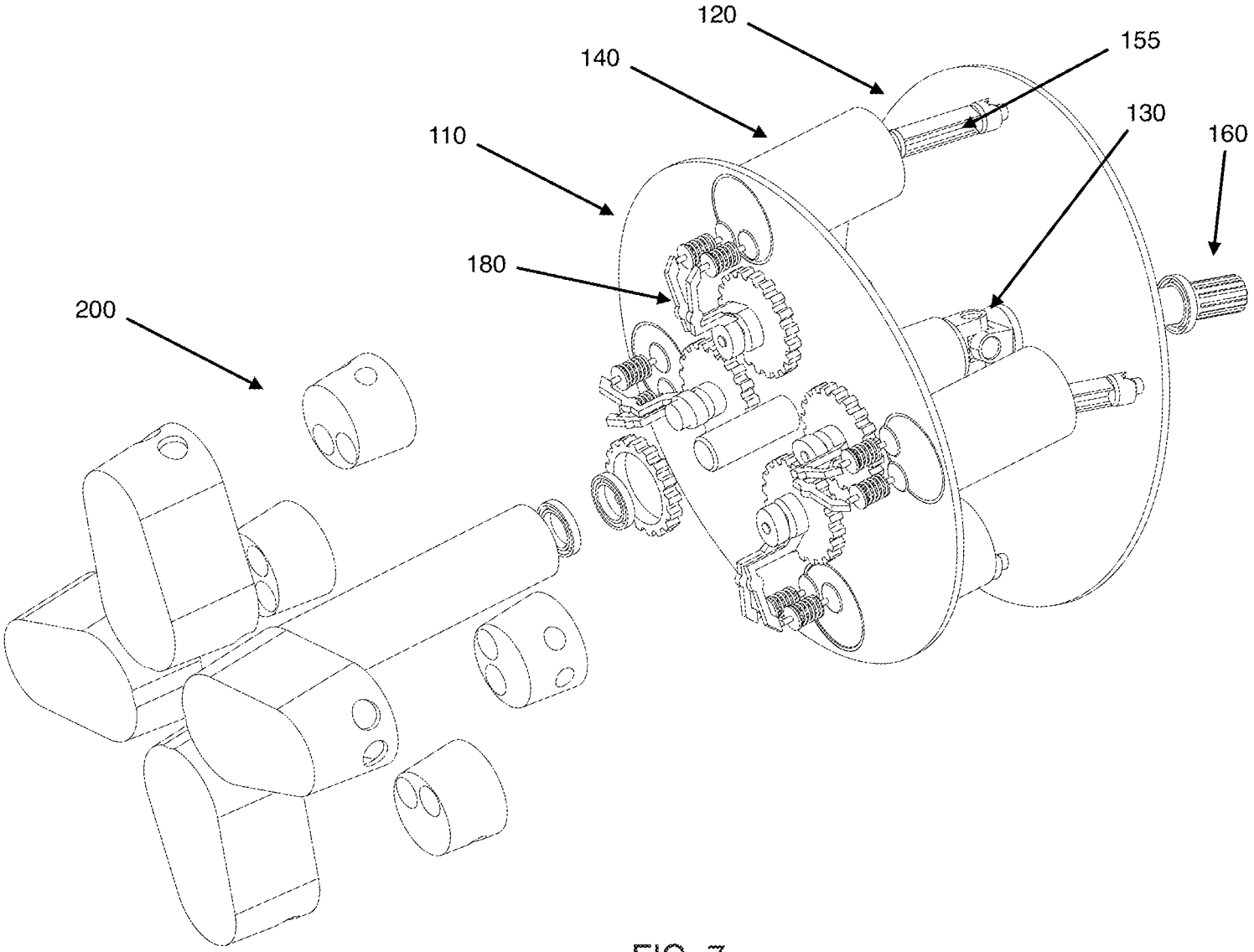
FIG. 7 depicts a perspective view of the casing of the rotational combustion engine.

A casing, such as casing 200, as illustrated in FIG. 7 may be used to cover parts of system 100. Casing 200 protects system 100 from outside debris and pollutants, as well as in case of engine failure. Casing 200 protects the driver of a vehicle by keeping broken debris inside casing 200.

Rotating internal combustion engine 100, in the preferred embodiment, may be a four-stroke engine in which pistons 150 completes four separate strokes while turning driving shaft 160, including the intake stroke, compression stroke, combustion stroke, and exhaust stroke. However, this is non-limiting and it should be noted that it would be obvious for rotating internal combustion engine 100 to be designed as a two-stroke engine. During the intake stroke, piston 150 moves away from the first surface of cylinder 140. A fuel air mixture is introduced into the combustion chamber through the intake passage and intake valve 190, whereby the fuel air mixture is pulled into the combustion chamber by piston 150, producing vacuum pressure in cylinder 140 from the piston's 150 receding action. Pistons 150 continue to recede until they reach the farthest point, the point at which pistons 150 is farthest from the first surface of cylinder 140.

During the compression stroke, inlet valve 190 and exhaust valve 195 are closed. The inertia of the driving shaft 160 and rotating motion of the first cam 110 and second cam 120 cause pistons 150 to move toward the first surface of cylinder 150 and compress the fuel air mixture. In the compression stroke, piston 150 reaches the closest point or substantially near the closest point to the first surface of cylinder 150. During the combustion stroke, inlet valve 190 and exhaust valve 195 remain closed and the compressed fuel air mixture is then ignited by an electric spark from the spark plug producing large volumes of carbon dioxide and water from the fuel air mixture that push piston 150 back to the farthest point. Because the electric spark from the spark plug occurs when piston 150 is at or near its closet point, the pressure exerted by the ignited fuel air mixture on piston 150 is at its greatest. This pressure is transmitted through pistons 150 to connecting rod 155 and rod connectors to second cam 120 or adapter gear and then driving shaft 160 thereby resulting in a torque or drive on driving shaft 160 rotating driving shaft 160 in a counterclockwise direction as well as first cam 110.

During the exhaust stroke, exhaust valve 195 is open and piston 150 returns to the nearest point to the first surface of cylinder 150, causing the products of combustion, including carbon dioxide, water vapor, and other hydrocarbons to exit through exhaust valve 195 and outlet passage.

On two revolutions of the first cam 110 and the second cam 120 or 720 degrees, pistons 150 complete a four-stroke movement in cylinder 140. The length of stroke is predetermined here by the position of second cam 120 or adapter gear of second cam 120 and the length of pistons 150, the position of the adapter gear being adjustable in one or more embodiments by adjusting the device or any other methods known by those of ordinary skill in the art.

Rotational combustion engine 100 may have a starter or starter motor configured to supply initial rotational motion to driving shaft 160 so as to initiate the rotational combustion engine 100 operation under its own power. Rotational motion to driving shaft 160 causes rotation in first cam 110, second cam 120, gear, and camshaft assembly, including the camshaft and lobes, thus initiating a cycle.

Figure 8:
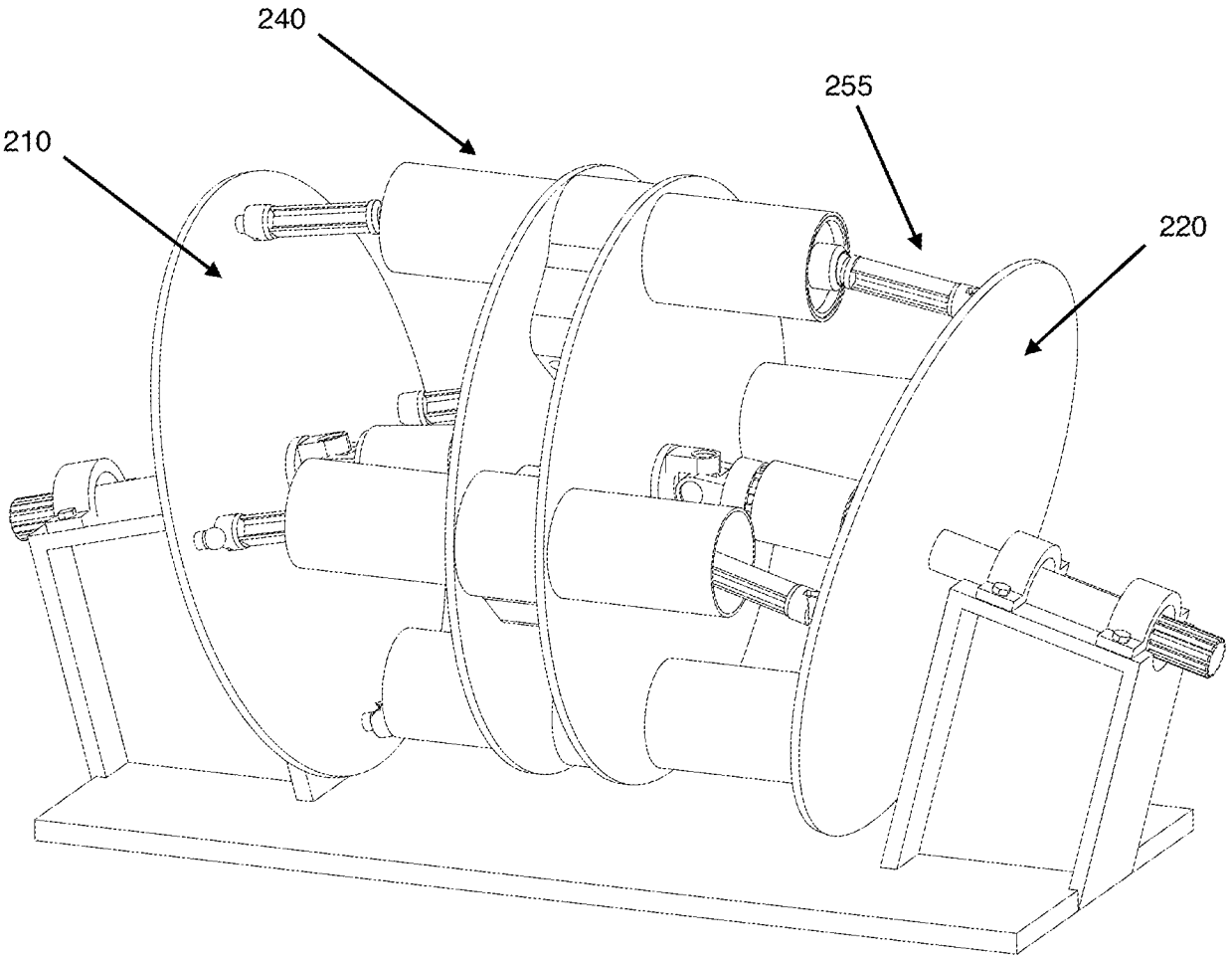
FIG. 8 depicts a perspective view of another embodiment of the rotational combustion engine.
Figure 9:
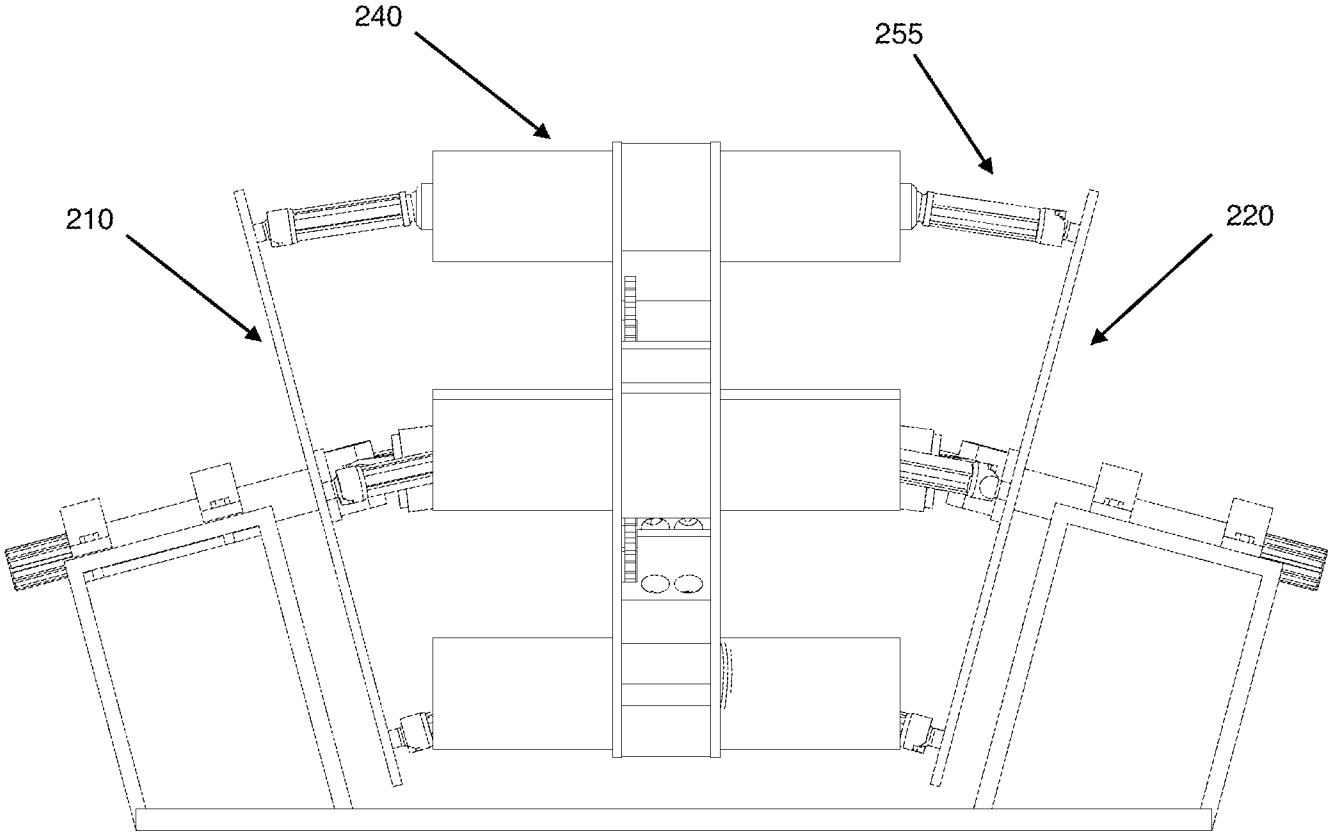
FIG. 9 depicts a side view of the rotational combustion engine in FIG. 8.
Figure 10:
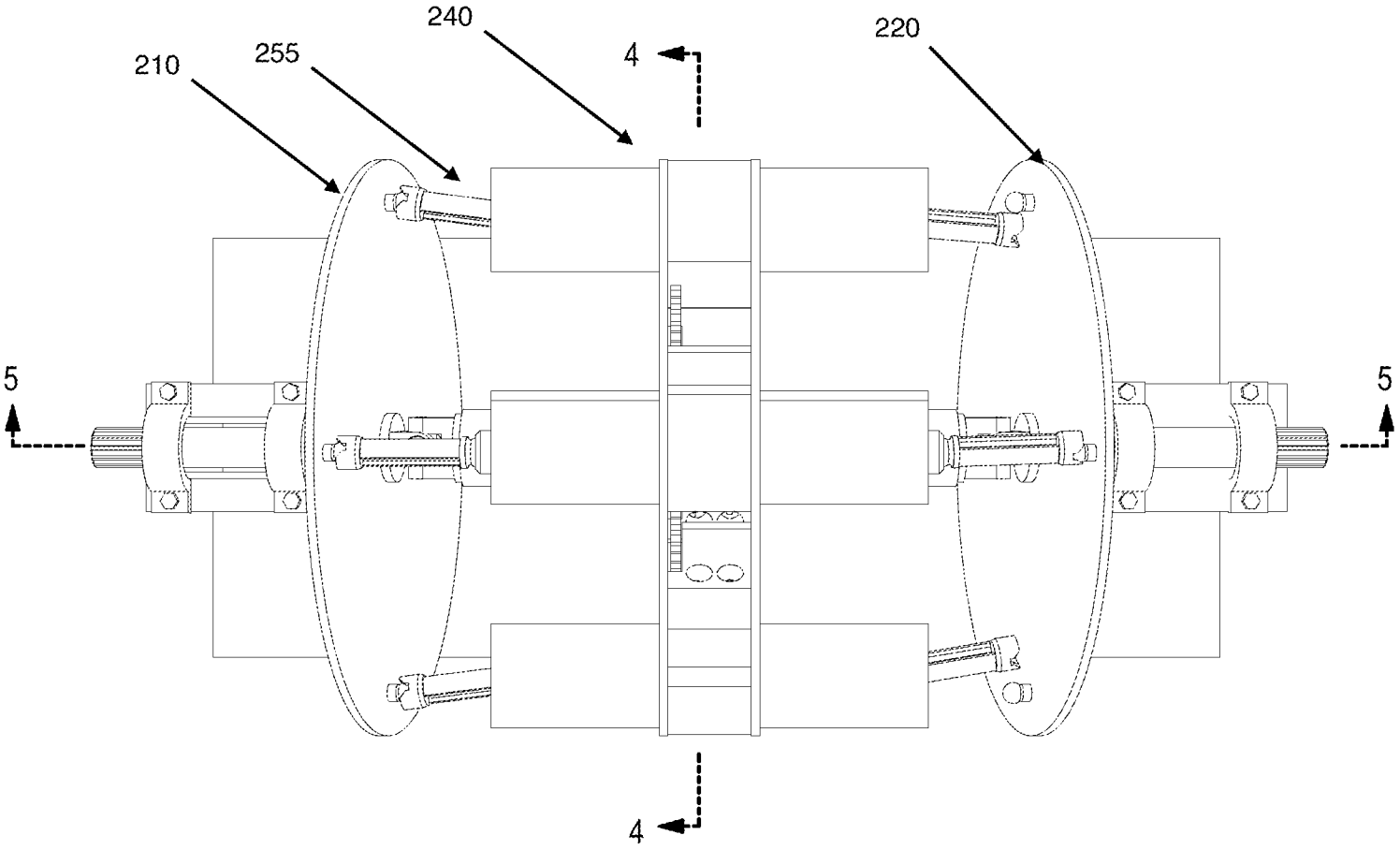
FIG. 10 depicts a top view of the rotational combustion engine in FIG. 8

Another embodiment is illustrated in FIGS. 8-10, whereby instead of the pistons acting on one cam, a pair of pistons in each cylinder act in unison on both cams so that rotational energy may be applied to two driving shafts instead of one. In this embodiment, a first cam such as first cam 210 and a second cam such as second cam 220 may have a plurality of apertures whereby a plurality of cylinders such as cylinders 240 are mounted on and connected to the first 210 and second cam 220 and positioned within the plurality of apertures. Cylinders 240 may be in axial alignment with each other on one plane while in other non-limiting embodiments may be at different angles.

Figure 11:
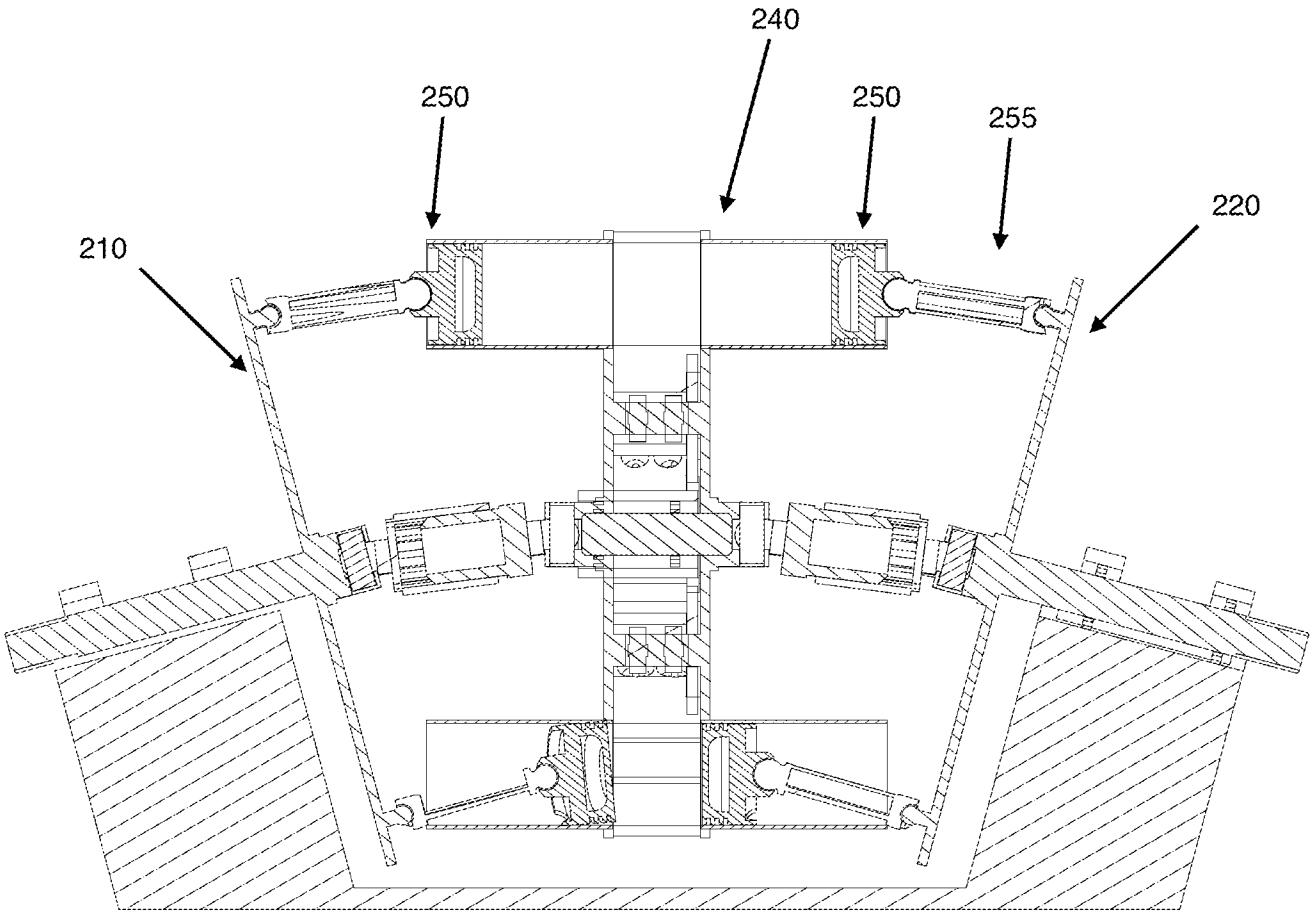
FIG. 11 depicts a cross sectional front view of the rotational combustion engine in FIG. 8.

Two pistons 250, as illustrated in FIG. 11 may fit slidably and displaceably within each of cylinders 240 (or in some embodiments two cylinders that are in coaxial alignment) whereby pistons 250 may be coaxial with cylinders 240 and have relative motion within cylinders 240. Pistons 250 may each have a connecting rod such as connecting rod 255 whereby the connecting rods have one or more rod connectors linked to first cam 210 and second cam 220 or an adapter gear mounted to first cam 210 and second cam 220 that moves in unison with cams 210 and 220. Cylinders 240 have a first end and a second end, the first end having a cylindrical opening in contact with first cam 210, the second end having a cylindrical opening in contact with second cam 220 or an adapter gear, and a middle section acting as a combustion chamber whereby the volume enclosed within the combustion chamber is between the walls of each cylinder 240 and pistons 250, the combustion chambers connected to an inlet port and exhaust port.

Figure 12:
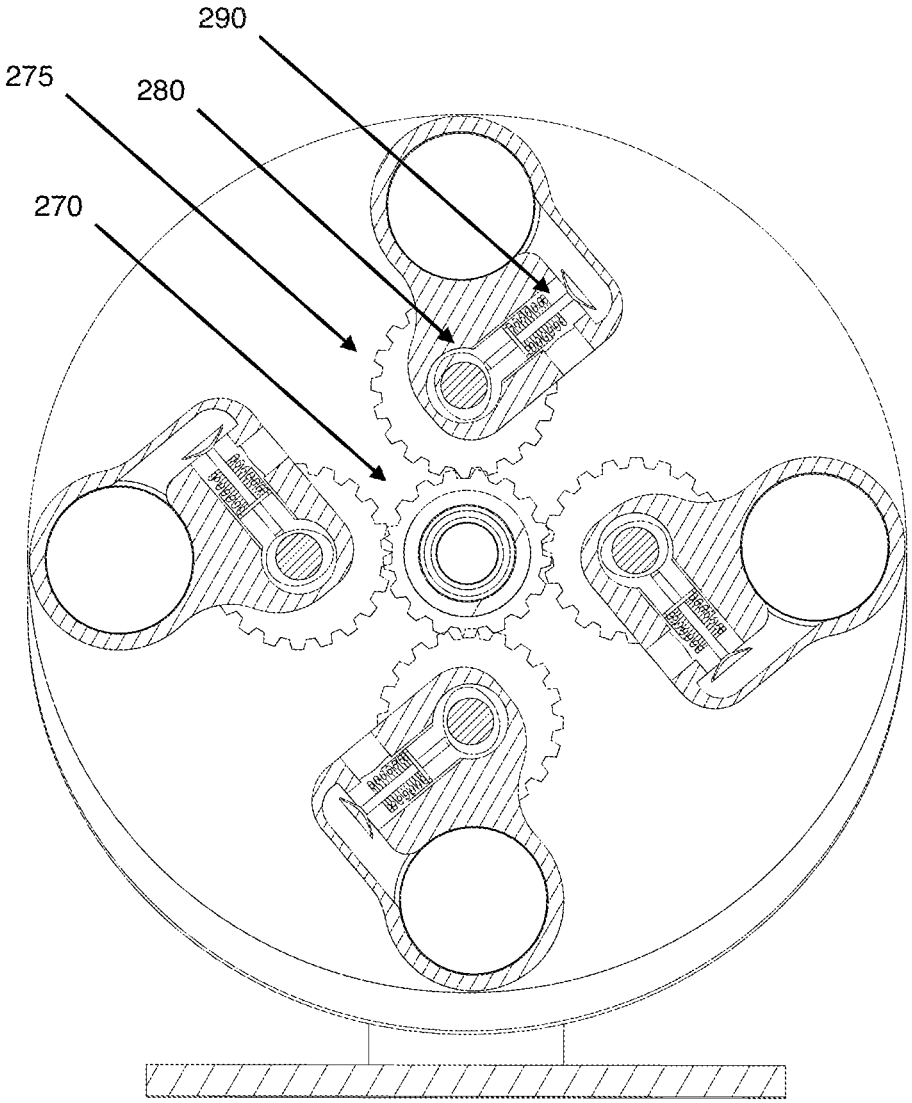
FIG. 12 depicts a cross sectional side view of the rotational combustion engine in FIG. 8.

Spark plugs may be mounted centrally in the combustion chamber in cylinders 240. Pistons 250 move in a similar fashion to the previous embodiment, however, the two pistons 250 in each chamber move in unison whereby the pressure from the combustion stroke is transmitted through pistons 250 to eventually first cam 210 and second cam 220. One or more intermediate cams may be positioned in between first cam 210 and second cam 220 whereby cams 210 and 220 hold the system in place as well as apply rotary motion to a series of gears, such as gear 270, secondary gears 275, and camshafts, such as camshafts 280, as illustrated in FIG. 12 to open and close valves such as valves 290.

In one or more other embodiments, rotational combustion engine 100 may employ direct or indirect fuel injection in place of the fuel air mixture or may be a diesel engine utilizing diesel fuel. In this embodiment, rotational combustion engine no longer requires a spark plug positioned within the cylinders whereby only air entering from an air inlet is compressed. The compression by pistons increases the air temperature inside cylinders to such a high degree that atomized diesel fuel injected from a fuel inlet into the combustion chamber ignites spontaneously.

In further embodiments the system is implemented not only for a rotational combustion engine but also for other uses such as a power generator which uses the mechanical energy from rotation of the cams or the driving shaft to produce alternating current electrical energy. In this embodiment cams or driving shaft are rotated to develop a rotating magnetic field that generates current in a current producing armature winding. The current producing armature winding is located in a stationary stator whereby the mechanical energy used to spin the cams or driving shaft in turn generates power through the stator.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated. The scope of the invention is to be defined by the below claims.

What is claimed is:

1. A machine comprising:

a first cam arranged at an angle on a vertical plane;

a connector attached to the first cam wherein the connector is a ball and socket mechanism;

a second cam attached to the connector arranged at an angle on the vertical plane at a horizontal offset compared to the first cam, the first cam and the second cam configured to rotate in unison;

one or more cylinders with an intake valve and an exhaust valve, the one or more cylinders attached to the first cam;

pistons attached to and movable within each cylinder of the one or more cylinders, the pistons configured to move as the first cam and the second cam rotate; and a driving shaft mounted for rotation about an axis connected to the second cam wherein the driving shaft and the second cam are configured to rotate in unison.

2. The machine of claim 1, wherein there is an acute angle between the first cam and the second cam.

3. The machine of claim 1, wherein the pistons each have a connecting rod, the connecting rods having one or more rod connectors connected to the second cam.

4. The machine of claim 3, wherein the first cam has a plurality of apertures wherein the one or more cylinders are positioned within the plurality of apertures.

5. The machine of claim 4, wherein the first cam is connected to a first gear mounted to a center of the first cam, the first gear configured to move in unison with the first cam.

6. The machine of claim 5, the first gear connected to a plurality of second gears, the plurality of second gears connected to a plurality of inlet camshafts and a plurality of outlet camshafts configured to control opening and closing of the intake valve and the exhaust valve.

7. The machine of claim 6, the plurality of inlet camshafts and the plurality of outlet camshafts having one or more lobes wherein when the plurality of inlet camshafts and outlet camshafts spin, the one or more lobes are configured to open and close the valve and the exhaust valve in time with motion of the pistons.

8. The machine of claim 7, wherein there are four cylinders.

9. A machine comprising:

a first cam arranged at an angle on a vertical plane;

a second cam arranged at an angle on the vertical plane at a horizontal offset compared to the first cam, the first cam and the second cam configured to rotate in unison;

a middle component with a first intermediate cam and a second intermediate cam and one or more combustion chambers;

a first set of cylinders, the first set of cylinders connected to the first intermediate cam;

a second set of cylinders, the second set of cylinders connected the second intermediate cam, the first set of cylinders and the second set of cylinders coaxial to each other;

a first set of pistons movable within the first set of cylinders; and a second set of pistons movable within the second set of cylinders; the second set of pistons in opposing direction to the first set of pistons, the first set of pistons and the second set of pistons configured to move as the first cam and the second cam rotate;

wherein a volume enclosed within one of the one or more combustion chambers is between one of the first set of pistons and one of the second set of pistons, the one or more combustion chambers each connected to an intake port and an exhaust port.

10. The machine of claim 9, wherein the horizontal offset is a 2 to 3-degree horizontal offset, wherein there is an acute angle between the first cam and the second cam.

11. The machine of claim 9 further comprising: a first driving shaft and a second driving shaft mounted for rotation about an axis extending connected to the first cam and the second cam wherein the first driving shaft and the second driving shaft, the first cam, and the second cam are configured to rotate in unison.

12. The machine of claim 11, wherein the first set of pistons and the second set of pistons each have a connecting rod, the connecting rods having one or more rod connectors connected to the first cam and the second cam, respectively.

13. The machine of claim 11, wherein the first intermediate cam and the second intermediate cam have a plurality of apertures wherein the first set of cylinders and the second set of cylinders are positioned within the plurality of apertures.

14. A machine comprising:

a first cam arranged at an angle on a vertical plane;

a connector attached to the first cam;

a second cam attached to the connector arranged at an angle on the vertical plane at a horizontal offset compared to the first cam, the first cam and the second cam configured to rotate in unison;

one or more cylinders, the one or more cylinders attached to the first cam or the second cam wherein the one or more cylinders are positioned between the first cam and the second cam; and pistons attached to and movable within each cylinder, the pistons configured to move as the first cam and the second cam rotate, wherein the first cam is connected to a first gear mounted to a center of the first cam, the first gear configured to move in unison with the first cam, wherein the first gear connected to a plurality of second gears, the plurality of second gears connected to a plurality of inlet camshafts and a plurality of outlet camshafts configured to control opening and closing of an intake valve and an exhaust valve, wherein the intake valve and the exhaust valve are connected to each of the one or more cylinders.

15. The machine of claim 14, wherein the connector is a ball and socket mechanism.

16. The machine of claim 15 further comprising: a driving shaft, the driving shaft mounted for rotation about an axis connected to the second cam wherein the driving shaft and the second cam are configured to rotate in unison, the driving shaft configured to develop a rotating magnetic field that generates current in armature winding located in a stator.

17. The machine of claim 14, the plurality of inlet camshafts and the plurality of outlet camshafts having one or more lobes wherein when the plurality of inlet camshafts and outlet camshafts spin, the one or more lobes are configured to open and close the intake valve and the exhaust valve in time with motion of the pistons.

18. The machine of claim 14, wherein the first cam and the second cam are separated by a sixty degrees angle wherein the horizontal offset is a 2 to 3-degree horizontal offset.

* * * * *